United States Patent [19]

Fratini

[11] 4,094,543

[45] June 13, 1978

[54] SNOW SHOVEL

[76] Inventor: Sabatino A. Fratini, 232 Crawford Ave., Lansdowne, Pa. 19050

[21] Appl. No.: 758,030

[22] Filed: Jan. 10, 1977

[51] Int. Cl.[2] ..... E01H 5/02

[52] U.S. Cl. ..... 294/54; 37/53

[58] Field of Search ..... 294/49, 54, 51, 52, 294/53.5, 55, 57; 37/16, 53; D15/11

[56] References Cited

U.S. PATENT DOCUMENTS

| | | | |
|---|---|---|---|
| 1,667,591 | 4/1928 | Eden | 37/53 |
| 3,091,790 | 6/1963 | Schroeder | 37/53 |
| 3,583,747 | 6/1971 | Lambert | 294/54 |

*Primary Examiner*—James B. Marbert

[57] ABSTRACT

A snow shovel is disclosed which is adapted to remove snow from various surfaces by pushing the shovel along the surface. Additionally, the shovel is adapted so that it may be used in a conventional manner, i.e. for use in lifting snow from one location to another. The shovel includes a handle assembly which is connected to a base which is set at a small angle to the snow-laden surface. The base is semi-circular in shape and has connected to it a vertically displaced member which is adapted to abut the snow as the shovel is being pushed.

2 Claims, 2 Drawing Figures

SNOW SHOVEL

BACKGROUND OF THE INVENTION

This invention relates to a shovel which is adapted for both pushing snow and for moving snow from one location to another, in a conventional manner.

Many different shovel designs are taught by the prior art. Shovels which are adapted for pushing snow are well known. The most common type of shovel for pushing snow consists of a curved but substantially vertical blade having a handle rigidly connected to it. Of course, the simplest type of shovel for pushing snow consists of a substantially flat vertical member rigidly connected to a handle.

U.S. Pat. No. 1,319,912 by Starrett and Round teaches a shovel adapted for both pushing snow and lifting snow in a conventional manner.

The present invention is an advance over the various types of pusher shovels taught by the prior art. The prior art shovels have required an excessive amount of strength on the part of the person using the shovel in order to effectively push snow. This has resulted from the fact that the blades of the shovel were essentially flat thereby resulting in maximum resistance of the snow to the forward motion of the shovel. Some of the shovel designs of the prior art have been relatively ineffective in pushing snow even though they were designed for that purpose in that the snow would flow over the top of the shovel blade when the shovel was pushed through the snow.

SUMMARY OF THE INVENTION

Accordingly, it is an object of the present invention to provide a shovel which may easily and efficiently be used to push snow and be used as a conventional snow shovel to lift snow from one point to another.

Another object of this invention is to provide a shovel adapted to push snow in such a manner that snow will tend to flow about and around the shovel as it is being pushed.

Another object of this invention is to provide a shovel which is adapted to easily and efficiently cause snow to flow around it when it is being pushed through the snow and which may be used as a conventional shovel to move snow from one point to another.

Other further objectives and advantages of the invention will be described in the description which follows, taken together with the accompanying drawings.

The shovel of the present invention includes a base which is adapted to be positioned above the surface from which it is desired to remove the snow. Pivotally connected to the base is a handle. The base is semi-circular in shape and is adapted to be pushed through the snow so that the center of the curved portion of the base is at the most forward point of the shovel. The shovel blade is connected to the base so that it is vertical and conforms to the semi-circular shape of the base. Thus, when the shovel is pushed through the snow the snow is impacted by the vertical face of the shovel blade and due to the semi-circular shape of the base blade combination the snow is caused to flow about the vertical blade.

BRIEF DESCRIPTION OF THE DRAWINGS

In the drawings in which like numerals refer to like parts:

FIG. I is a perspective view of the present invention.

Figure 1:
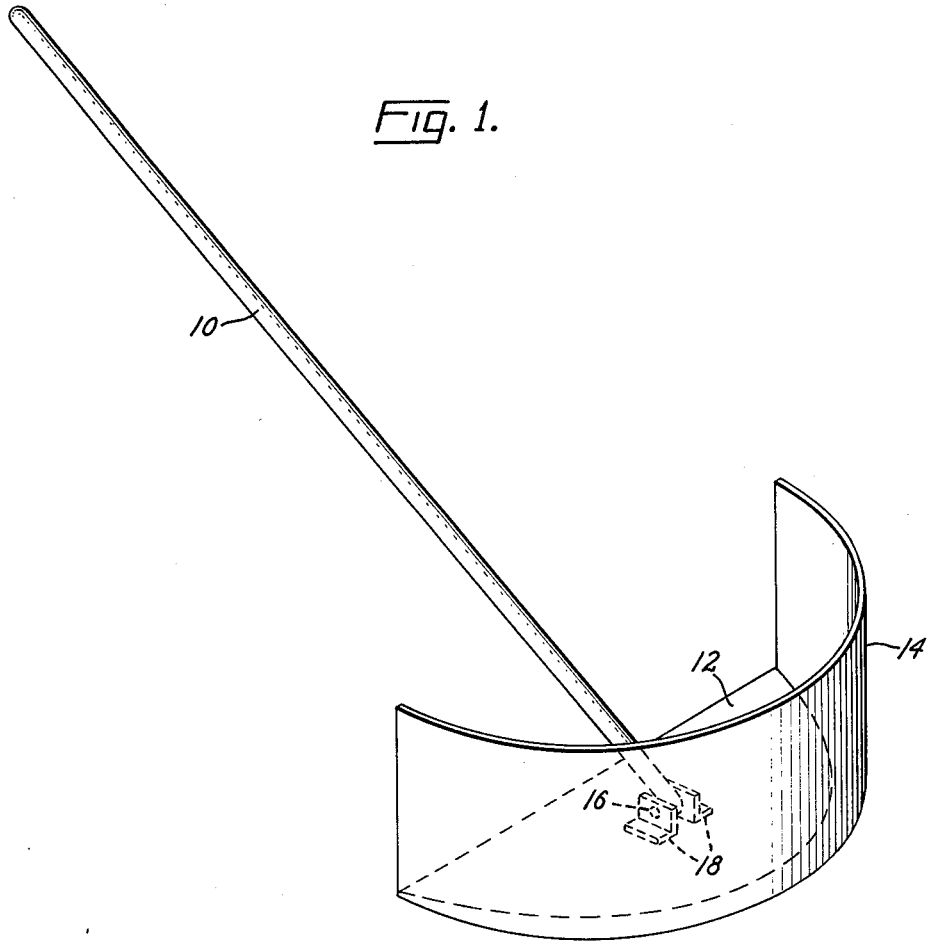
Figure 2:
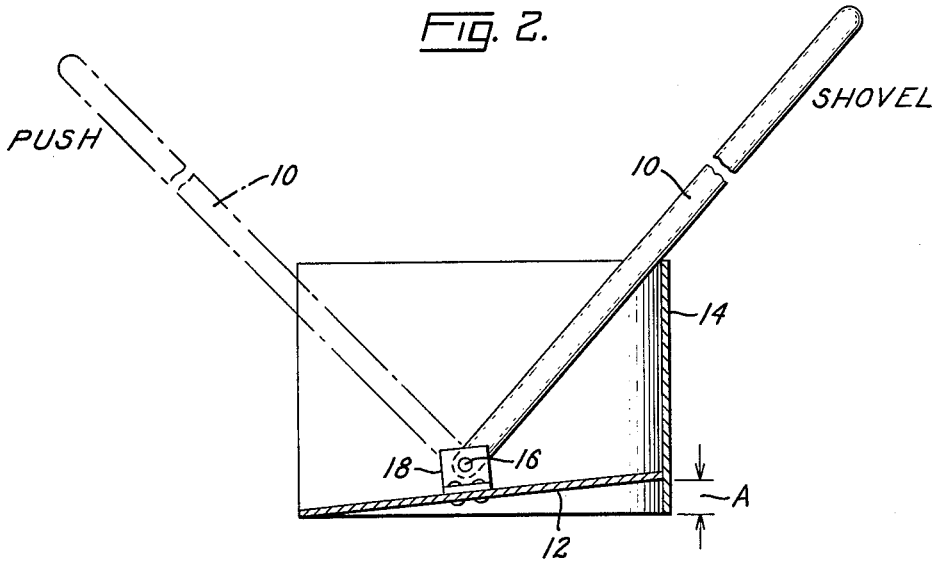

FIG. II is another perspective view of the present invention showing it adapted for use as a conventional shovel for moving snow from one point to another.

DESCRIPTION OF THE PREFERRED EMBODIMENT

In FIG. I the shovel of the present invention, adapted for pushing snow, is shown having a handle 10 connected to a base 12 having a vertical blade 14 connected to it. As may be seen in FIG. I the base 12 is raised a distance A above the bottom edge of the bottom of the blade 14.

The handle 10 is pivotally connected to the base 12 by a pin 16 which passes through the handle 10 and a pair of flanges 18. The pin is restrained by suitable means such as a washer and nut; any other acceptable manner for securing the pin will suffice.

From most applications the distance A, the distance above which the base is positioned above the lower edge of the blade 14, will be approximately an inch. The reason the base is raised above the lower edge, will be approximately an inch. The reason the base is raised above the lower edge of the blade is so that a sharp edge may be presented to the surface upon which the snow is resting. Were the base to be connected to the blade at its lower edge there would be a tendency for the shovel to skim or slide over the surface of the snow it is desired to remove.

The degree of curvature and shape with which the blade 14 presents to the snow is determined by the shape or planned form of the base 12. For most applications a circular shape is proven more than sufficient. In some cases a more severe degree of curvature may be desired. As used herein the term semi-circular would include such additional shapes. A circular shape was selected for the present embodiment of the invention for ease in manufacturing. Specifically, a semi-circular shape was selected as no practical purpose would be served, for obvious reasons, and having the rearward portion of the base of a circular shape.

In FIG. II the present invention is shown adapted to be used as a conventional shovel. This is accomplished by moving the handle 10 of the shovel so that it abuts against the blade 14. When positioned in this manner the handle 10 will remain in contact with the blade 14 as the center of gravity of the shovel base blade combination is rearward of the pivot point of the shovel, when the shovel is in its pushing mode. When adapted to be used as a conventional shovel as is shown in FIG. II the trailing edge of the base 12 becomes the surface for engaging the snow.

Numerous variations and modifications of the above-described invention will occur to those skilled in the art in light of this disclosure and the prior art. It is contemplated, therefore, that the present invention may be practiced otherwise than specifically described herein while remaining within the scope of the following claims which define the invention.

What is claimed is:

1. An apparatus for snow displacement which comprises:

a semi-circular flat base plate;

a curved panel having a lower edge and straight diametric edge, said panel being substantially at a right angle with respect to said base, rigidly connected to the curved portion of said base plate such that the plane of the base is at a small angle with respect to the ground, and said lower edge and said straight diametric edge being in contact with the ground when said apparatus is in use; and a handle pivotally connected to said base plate which permits an operator to push said apparatus, thereby causing the convex outer surface of said vertical curved panel to contact the snow and impact it so that the snow will flow around and be displaced by said apparatus.

2. The apparatus of claim 1 wherein said handle can be pivoted longitudinally with respect to said base so that it may come to rest at the center of the top edge of the vertical panel, thus allowing said apparatus to be pushed through the snow such that said diametric edge of said base plate will cut through the snow as it contacts the ground causing the snow to flow onto the base place until it contacts said vertical panel which acts as a backstop to cause the snow to accumulate within the apparatus for subsequent discharge to the side, thereby permitting the apparatus to be used as a conventional snow shovel.

* * * * *